United States Patent [19]

Döppling et al.

[11] Patent Number: 4,579,094

[45] Date of Patent: Apr. 1, 1986

[54] CUP-SHAPED CASING FOR A HYDRAULIC TAPPET

[75] Inventors: Horst Döppling, Herzogenaurach; Walter Speil, Ingolstadt; Georg Schaeffler, Herzogenaurach, all of Fed. Rep. of Germany

[73] Assignee: Motomak Motorenbau, Maschinen-und Werkzeugfabrik Konstruktionen GmbH, Fed. Rep. of Germany

[21] Appl. No.: 703,883

[22] Filed: Feb. 21, 1985

[30] Foreign Application Priority Data

Mar. 31, 1984 [DE] Fed. Rep. of Germany ..... 3412175

[51] Int. Cl.[4] ..... F01L 1/24

[52] U.S. Cl. ..... 123/90.55; 123/90.51

[58] Field of Search ..... 123/90.55, 90.51, 90.58, 123/90.56, 90.57, 90.59

[56] References Cited

U.S. PATENT DOCUMENTS

| | | | |
|---|---|---|---|
| 2,887,098 | 5/1959 | Thompson | 123/90.51 |
| 3,658,038 | 4/1972 | Bergmann | 123/90.51 |
| 4,367,701 | 1/1983 | Buente | 123/90.51 |
| 4,392,462 | 7/1983 | Lesher | 123/90.55 |
| 4,397,271 | 8/1983 | Gardner | 123/90.55 |
| 4,437,439 | 3/1984 | Speil | 123/90.55 |
| 4,465,038 | 8/1984 | Speil | 123/90.55 |
| 4,470,381 | 9/1984 | Buente et al. | 123/90.51 |

FOREIGN PATENT DOCUMENTS

| | | | |
|---|---|---|---|
| 2754446 | 6/1979 | Fed. Rep. of Germany | 123/90.55 |
| 2948669 | 6/1981 | Fed. Rep. of Germany | 123/90.55 |

*Primary Examiner*—Ira S. Lazarus

*Attorney, Agent, or Firm*—Bierman, Peroff & Muserlian

[57] ABSTRACT

A cup-shaped casing of a self-adjusting hydraulic tappet for overhead camshaft internal combustion engines, the casing comprising a hollow cylindrical outer part (1) closed at one end by an end member (3) and disposed concentrically therein a hollow cylindrical inner element (4) sealingly connected at its end distal from end member (3) to the bore of the outer part (1) by an annular flange (5), the actual clearance-compensating element (9) being guided in inner element (4) and having around it an annular oil reservoir (10) bounded radially by cylinder wall (2) of outer part (1) and bounded axially by end member (3) of outer part (1) and by flange (5), the outer generated surface of outer part (1) being provided with a peripheral groove (7), characterized in that peripheral groove (7) is axially at least as far from end member (3) as the transition between flange (5) and cylinder wall (2) of outer part (1) and an axial groove (11) starts from peripheral groove (7) at at least one place on the periphery and extends to near the oil reservoir (10) or a chamber (14) communicating therewith and its end zone communicates by through bore (12,17) with the oil reservoir (10) or the chamber (14).

4 Claims, 3 Drawing Figures

CUP-SHAPED CASING FOR A HYDRAULIC TAPPET

STATE OF THE ART

Figure 1:
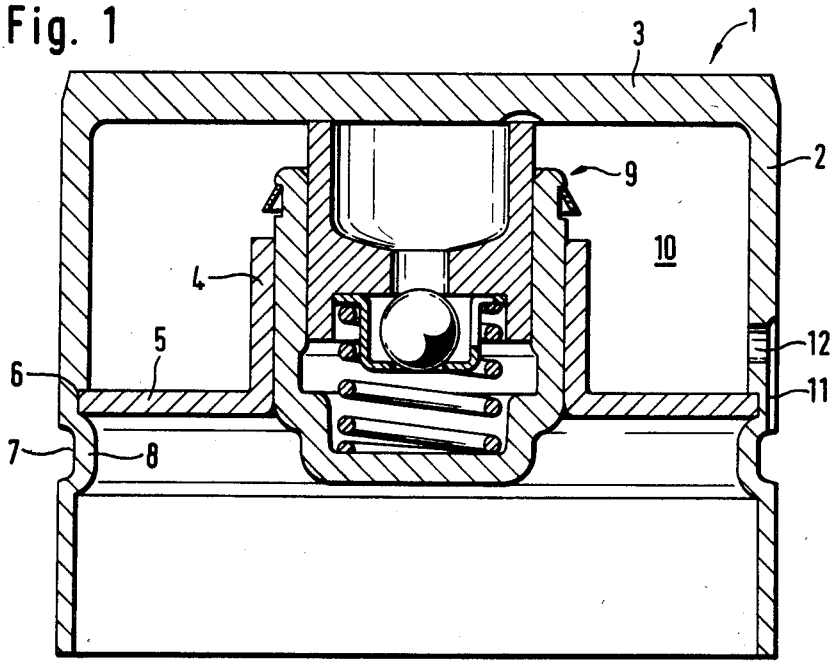

In known cup-shaped casings of self-adjusting hydraulic tappets for overhead camshaft internal combustion engines wherein the casing is comprised of a hollow cylindrical outer part and has disposed concentrically therein a hollow cylindrical inner element, the inner element being sealingly connected at its end distal from the end member to the bore of the outer part by an annular, more particularly funnel-shaped, flange, the actual clearance-compensating element being guided in the inner element and having around it an annular oil reservoir bounded radially by the envelope of the outer part and by the inner part and axially by the end member of the outer part and by the flange, the outer generated surface of the outer part being formed with a peripheral groove, oil is supplied to the oil reservoir by a peripheral groove with which the outer generated surface of the outer part is formed near the longitudal dimension of the oil reservoir, through bores which are present at one or more places on the periphery extending from the peripheral groove into the oil reservoir. Oil is supplied to the peripheral groove from the lubricant circuit of the engine through a supply bore which at an appropriate place extends into the guide bore for the casing, the guide bore being in the cylinder head of the engine.

In this construction, oil enters the cylinder head through the annular gap between the latter bore and the casing which is an undesirable phenomenon. Attempts have therefore been made to place the peripheral groove very far away from the end member of the outer part so that the sealing length in the gap between the guide bore and the casing envelope may be very considerable. This means that the oil reservoir must have a relatively substantial axial dimension if the through bores starting from the peripheral groove are still to extend into the oil reservoir.

However, recent trends are to move the flange very close to the casing end member to reduce the overall height of the engine. However, the peripheral oil supply groove would then also have to be moved closed to the end member, with a consequent considerable reduction in the sealing length between the guide bore and the outer envelope of the casing so that there would be an undesirable increase in the oil entering the cylinder head.

OBJECTS OF THE INVENTION

It is an object of the invention, despite a decrease in the distance between the flange and the casing end member, to be able to dispose the peripheral oil supply bore far enough away from the casing end member to ensure that the entry of oil in the cylinder head is very reduced.

This and other objects and advantages of the invention will become obvious from the following detailed description.

THE INVENTION

The novel cup casing of the invention of a self-adjusting hydraulic tappet for overhead camshaft internal combustion engines comprised of a hollow cylindrical outer part closed at one end by an end member and disposed concentrically therein a hollow cylindrical inner element sealingly connected at its end distal from the end member to the bore of the outer part by an annular flange, the actual clearance-compensating element being guided in the inner element and having around it an annular oil reservoir bounded radially by the cylinder wall of the outer part and bounded axially by the end member of the outer part and by the flange, the outer generated surface of the outer part being provided with a peripheral groove, is characterized in that the peripheral groove is axially at least as far from the end member as the transition between the flange and the cylinder wall of the outer part and an axial groove starts from the peripheral groove at at least one place on the periphery and extends to near the oil reservoir or a chamber communicating therewith and its end zone communicates by a through bore with the oil reservoir or the chamber.

As the peripheral groove in the outer generated surface of the outer part is axially at least as far away from the end member as the transition between the flange and the generated surface of the outer part, and an axial groove starts from the peripheral groove at at least one place on the periphery and extends to near the oil reservoir or a chamber communicating therewith and its end zone communicates by way of a through bore with the oil reservoir or the chamber, oil can transfer satisfactorily from the peripheral groove to the oil reservoir even when the peripheral groove is appreciably further away from the casing end member than the flange. The axial groove reduces the axial sealing length between the supply bore and the casing in a zone corresponding to the peripheral extent of the axial groove; however, the substantial sealing length remains operative over the whole of the remainder of the periphery so that there is no risk of an excessive amount of oil entering the cylinder head.

There are various ways of forming the axial groove, for instance, by a chip-removing operation or by stamping without the removal of material. Very advantageously, the axial groove is a punched-out or stamped-out zone which extends through the cylinder wall of the outer part and which is partly covered on the inside of the latter surface by a collar formed on the flange so that a through aperture remains only on that side of the flange which is near the end member.

In some cases, the flange is moved so close to the casing end member that the end of the axial groove would come so close to the casing end near the end member that a very substantial oil leakage would be likely near the axial groove. To obviate this disadvantage, the outer edge of the flange merges into a hollow cylindrical collar which is distal from the end member of the casing, which at least in the region of its free end is sealingly connected to the bore of the outer part and at at least one place on its periphery co-operates with the latter bore to bound an axial duct open towards the oil reservoir, the through bore starting from the axial groove and communicating with the latter duct. The total length to be overcome from the peripheral groove to the oil reservoir is divided in this way into two partial lengths, one represented by the axial groove which starts from the peripheral groove while the other is the internal duct bounded by the flange collar and by the bore of the outer part. An even greater distance between the outer peripheral groove and the oil reservoir can be bridged in this way without any risk of excessive oil leakage.

Figure 2:
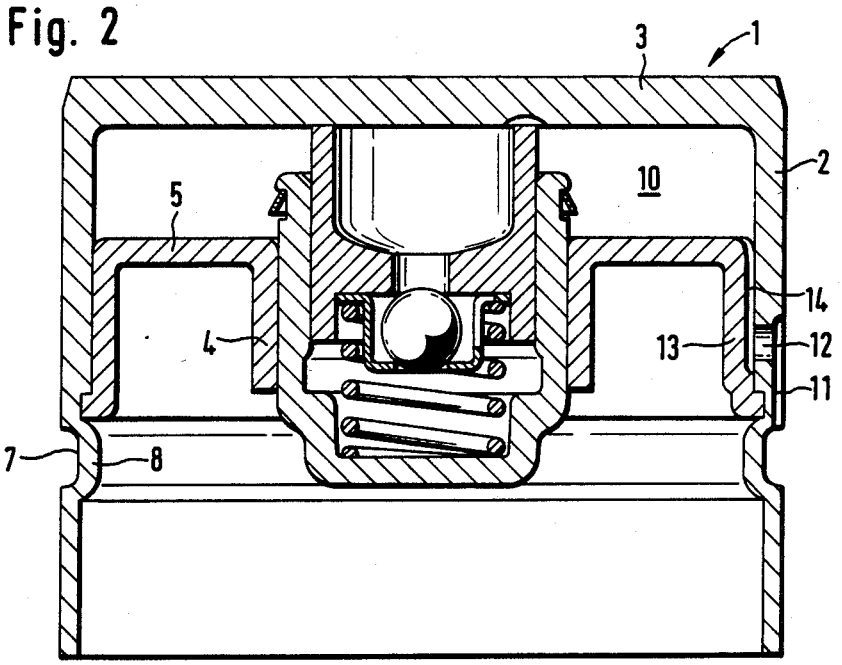
Figure 3:
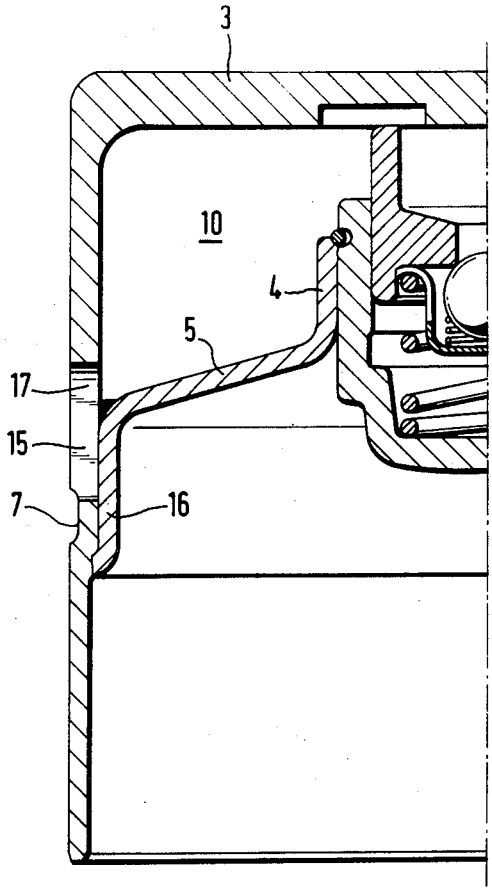

Referring now to the FIGS.:

FIGS. 1 to 3 are longitudinal cross-sectional views of three embodiments of a casing of the invention with different configurations for flange (5)

A cup-shaped casing shown in FIG. 1 comprises an outer part 1 having a hollow cylinder wall 2 closed at one end by an end member 3. An inner part 4 is disposed concentrically in the outer part 1 and is connected by an annular flange 5 to the bore of the cylinder wall 2. To provide the connection, flange 5 with its one side bears on a shoulder or step 6 in the latter bore and with its other side on a bead 8 which forms when a peripheral groove 7 is impressed by rolling engages flange 5. Further sealing of this joint can be provided by soldering or welding. A clearance-compensating element 9 is guided for longitudinal movement in inner part 4.

The elements 2 to 5 and the clearance-compensating, element 9 bound an annular oil reservoir 10 and oil is supplied thereto through peripheral groove 7 in the outer surface of cylinder wall 2. An axial groove 11 starts at a place on the periphery from groove 7, extends to near reservoir 10 and communicates in its end zone with a through bore 12. A reliable supply of oil from groove 7 to reservoir 10 is therefore ensured although groove 7 and reservoir 10 are spaced apart axially from one another.

The variant shown in FIG. 2 differs from FIG. 1 mainly in that flange 5 starts from that end of inner part 4 which is near end member 3, so that the downwardly open space in outer part 1 is appreciably enlarged axially. The outer edge of flange 5 merges into a hollow cylindrical collar 13 which is distal from end member 3 and which, like flange 5 of FIG. 1, is secured in the bore of outer part 1. Collar 13 is so crimped at a place on its periphery as to co-operate with the bore of cylinder wall 2 to bound an axial duct 14 open towards reservoir 10. Through bore 12 which starts from axial groove 11 in cylinder wall 2 extends into that end of duct 14 which is distal from end member 3.

The embodiment of FIG. 3 differs from the embodiment of FIG. 1 mainly in that instead of axial groove 11, there is a longitudinally punched-out or stamped-out zone 15 which starts from peripheral groove 7 and extends to near reservoir 10. Zone 15 is so internally covered over some of its length by a collar 16 that a through aperture 17 remains only on that side of flange 5 which is near end member 3. In contrast to the previous embodiments, flange 5 of this embodiment is funnel-shaped and not annular.

Various modifications of the casing of the invention may be made without departing from the spirit or scope thereof and it is to be understood that the invention is intended to be limited only as defined in the appended claims.

What we claim is:

1. A cup-shaped casing of a self-adjusting hydraulic tappet for overhead camshaft internal combustion engines, the casing comprising a hollow cylindrical outer part (1) closed at one end by an end member (3) and disposed concentrically therein a hollow cylindrical inner element (4) sealingly connected at its end distal from end member (3) to the bore of the outer part (1) by an annular flange (5), the actual clearance-compensating element (9) being guided in inner element (4) and having around it an annular oil reserovir (10) bounded radially by cylinder wall (2) of outer part (1) and bounded axially by end member (3) of outer part (1) and by flange (5), the outer generated surface of outer part (1) being provided with a peripheral groove (7), characterized in that peripheral groove (7) is axially at least as far from end member (3) as the transition between flange (5) and cylinder wall (2) of outer part (1) and an axial groove (11) starts from peripheral groove (7) at at least one place on the periphery and extends to near the oil reservoir (10) or a chamber (14) communicating therewith and its end zone communicates by through bore (12,17) with the oil reserovoir (10) or the chamber (14).

2. The casing of claim 1 wherein flange (5) is funnel-shaped.

3. A casing of claim 1 wherein the axial groove (11) is a punched-out or stamped-out zone (15) which extends through the cylinder wall (2) of the outer part (1) and which is partly covered on the inside of the latter surface by a collar (16) formed on flange (5) whereby a through aperture (17) remains only on that side of the flange (5) which is near end member (3).

4. A casing of claim 1 wherein the outer edge of flange (5) merges into a hollow cylindrical collar (13), which is distal from end member (3), which at least in the region of its free end is sealingly connected to the bore of the outer part (1) and at at least one place on its periphery co-operates with the latter bore to bound an axial duct (14) open towards the oil reservoir (10), the through bore (12) starting from the axial groove (11) and communicating with the latter duct (14).

* * * * *